US005603634A

United States Patent [19]

Ichikawa et al.

[11] Patent Number: 5,603,634

[45] Date of Patent: Feb. 18, 1997

[54] SMALL PITCH DUAL ROW LEAF CONNECTOR

[75] Inventors: Shozou Ichikawa, Kawasaki; Naoya Matsuura, Yokohama, both of Japan

[73] Assignee: Molex Incorporated, Lisle, Ill.

[21] Appl. No.: 546,654

[22] Filed: Oct. 23, 1995

[30] Foreign Application Priority Data

Nov. 21, 1994 [JP] Japan ..... 6-311085

[51] Int. Cl.[6] ..... H01R 4/24

[52] U.S. Cl. ..... 439/404; 439/607; 439/660

[58] Field of Search ..... 439/98, 99, 395, 439/404, 405, 607, 609, 610, 660, 701

[56] References Cited

U.S. PATENT DOCUMENTS 5,122,078 6/1992 Davis et al. ..... 439/405
5,487,682 1/1996 Miller et al. ..... 439/607
5,492,485 2/1996 Drewanz et al. ..... 439/404
5,549,488 8/1996 Berndt et al. ..... 439/701 X

*Primary Examiner*—Khiem Nguyen
*Attorney, Agent, or Firm*—Charles S. Cohen

[57] ABSTRACT

An electrical I/O connector is particularly suitable for docking-type connection applications and has a terminal block assembly held within a protective exterior casing. The terminal block assembly includes two interengaging halves which receive a plurality of metal terminals disposed thereon in a spaced-apart order. The terminals define two groups of terminals on each surface of the terminal block assembly halves and the two groups are defined by staggering the terminals lengthwise. A spacer is provided between the terminal block halves to maintain the terminals in their spaced apart order and includes projections which support insulation displacement terminals which extend from the terminals on opposite sides of the terminal block assembly. These insulation displacement terminals are arranged in a two separate tiers, which enable the connector to have an increased terminal density.

24 Claims, 7 Drawing Sheets

SMALL PITCH DUAL ROW LEAF CONNECTOR

BACKGROUND OF THE INVENTION

The present invention relates generally to electrical connectors and more particularly relates to a dual row leaf connector having multiple contact terminals of increased density.

Many electrical connectors, are well-known in the art, such as shielded I/O connectors. These I/O connectors typically include a male part, known as a plug, which interengages with a female part, known as receptacle, to establish a reliable electrical connection between electronic devices such as computers and the like. I/O connectors are characterized by a large number of terminals which accommodate multiple circuits, usually data transmission circuits in computers and these type of connectors are being used more often as "docking" style connectors suitable for instances for example, in which a notebook or laptop computer is mated with another CPU or monitor station.

Each male and female connector part contains a terminal block with a plurality of terminals which are connected to a like number of circuit wires. The terminals are typically arranged along the width of the terminal block and protrude into an engagement position on the block. The connector also include a protective exterior casing which encloses the wires and portions of the terminal block. A metal shell may also be provided which extends from the casing outwardly to enclose the terminal block and its associated terminals. This shell also defines a structure surrounding the terminals and which provides a mating surface for the male and female parts of the connector.

An I/O type of connector includes a preselected number of terminals which match the required number of output or input circuits of the electronic device. The electronics industry is constantly seeking to further reduce the size of electronic devices. As such, manufacturers seek to increase the number of circuits accommodated by a single connector which also reduces the need for additional connectors. This increase in the number of terminals has typically been accomplished in the past by reducing the lateral size, i.e. width, of each terminal or by reducing the spacing between terminals increasing the overall lateral dimensions of the connector itself.

This manner of increasing terminal density is not without disadvantages, because when the width of the terminals or the spacing therebetween terminals are reduced without increasing the width of the connector, the operational characteristics of the connector may be detrimentally affected because with thinner terminals, the probability of misalignment between terminals of the male and female connector parts increases. Additionally, as the number of circuits which a connector must handle increases, the need for a connector structure which holds the circuit wires in place on the connector also increases.

SUMMARY OF THE INVENTION

The present invention is therefore directed to a connector which accommodates an increased number of terminals and which overcomes the disadvantages set forth above. Accordingly, one object of the present invention is to provide an electrical connector which has an increased number of terminals in a given limited space without causing any adverse effect when the plug and receptacle members of the connector are mated together.

Another object of the present invention is to provide a reduced pitch dual row leaf terminal block assembly for use in an I/O connector wherein the terminal block has a pair of terminal supports, and each terminal support having upper and lower sets of terminals disposed thereon, each of the upper and lower terminal sets being further divided into two distinct groups, the terminals having wire engagement portions disposed on the terminal blocks rearwardly from contact blade portions of the terminals, the wire engagement portions of the upper and lower terminal sets being disposed in spaced-apart order lengthwise on opposing sides of the terminal supports, wherein the wire engagement portions of adjacent terminals are further staggered with respect to each other to reduce bunching of wires due to the reduced pitch of the assembly.

A further object of the present invention is to provide an improved I/O connector of reduced pitch wherein the connector includes a terminal block having a plurality of terminals disposed thereon, the terminals having an elongated contact blade portions extending longitudinally along the terminal block and wire engagement portions associated therewith in the form of wire displacement terminals and disposed rearwardly of the contact blade portions, the terminals further being arranged in two distinct groups on the terminal block, wherein the wire engagement portions of each distinct group of terminals are staggered between adjoining terminals and spaced apart between distinct groups of terminals, the terminal block further including means, in the form of cover plates which engage the wire displacement terminals to maintain wires in contact therewith.

Still yet another object of the present invention is to provide a terminal block assembly for use in I/O and other style connectors having an increased terminal density at a reduced pitch approaching 1 mm, wherein the terminal block assembly includes a plurality of terminals disposed thereon in a staggered arrangement and disposed thereupon at different elevations so that wires terminated thereto may lie in two rows, one above the other.

In order to attain these and other objects and advantages, the present invention provides for an electrical connector having a terminal assembly which includes a terminal block disposed within a protective exterior connector casing. The terminal block includes at least two terminal supports extending along the length of the assembly and having two distinct groups of terminals arranged on the upper and lower surfaces thereof. Each terminal includes an elongated contact blade portion and a hermaphroditic wire engagement portion at its rear end which permits the terminals to be used in substantially interchangeably fashions on either the upper or lower surface of the terminal block supports. The terminal groups are disposed on associated terminal supports of the terminal blocks and are spaced apart with respect to each other both laterally and longitudinally. The wire engagement sections of the terminals are likewise staggered in their position both along the width and length of the terminal block. The two groups of terminals are defined on each support surface by being spaced apart from each other lengthwise along the connector.

This structural arrangement advantageously permits the number of terminals to be increased without disadvantageously increasing the size of the electrical connector and further assures that reliable mating of the terminals of opposing interengaging male and female connector portions occurs when coupling the plug and receptacle together.

The connector may further include one or more cover plates which are applied to the terminal supports above the staggered wire engagement portions to maintain and press the individual wires together into engagement with the terminals of the connector. The cover plate arrangement facilitates quick connection of conductors of the wire cable to terminals of the connector member and accordingly, each cover plate may have a plurality of slots which engage the terminal wire engagement portions which also facilitates lateral arrangement of the conductors of the wire cable in alignment with the terminals of the connector.

In accordance with one embodiment of the present invention, the terminals include insulation displacement terminals as their wire engagement portions and which are arranged in a manner so that the wire engagement portions are staggered with respect to adjoining terminals in each group of terminals. This arrangement permits a significant reduction of the pitch of the terminals in each terminal group on the terminal supports to thereby increase the terminal density of the connector, without any significant increase in the lateral dimensions of either the terminals or connectors. A preferred width of the terminal is thereby retained so that the present invention also substantially reduces any misalignment which may occur between male and female terminals of opposing connector members as might be caused by decreasing the lateral size of terminals in an attempt to increase terminal density of the electrical connectors.

In accordance with another aspect of a preferred embodiment of the present invention, the terminal supports cooperate with a spacer held therebetween in the terminal block assembly. This spacer includes a plurality of spaced-apart land portions which extend in alignment with respective terminals in place upon the terminal supports. These land portions engage the terminals and assist in holding them in place on the terminal supports. The spacer still further includes a plurality of projections aligned with the wire engagement portions of the terminals. These protrusions provide support to the terminal wire engagement portions in order to prevent their displacement during wire assembly.

Furthermore, the positioning of the wire engagement portions of the terminals of one group spaced apart from those of an other terminal group associated with the same terminal support facilitates sequential connections of wire conductors of electrical cable to their respective terminal groups.

These and other objects, features and advantages of the present invention will be clearly understood through a consideration of the following detailed description.

BRIEF DESCRIPTION OF THE DRAWINGS

In the course of the following description of the detailed description, reference will be made to the attached drawings wherein like reference numerals identify like parts and wherein.

DESCRIPTION OF THE PREFERRED EMBODIMENTS

The present invention relates to electrical connectors such as I/O connectors which have interengaging plug and receptacle members. Either the plug or the receptacle may include similar structure in accordance with the principles of the present invention and obtain the particular benefits and advantages thereof. Therefore, the following description will be directed mainly to the plug member of such a connector.

Figure 1:
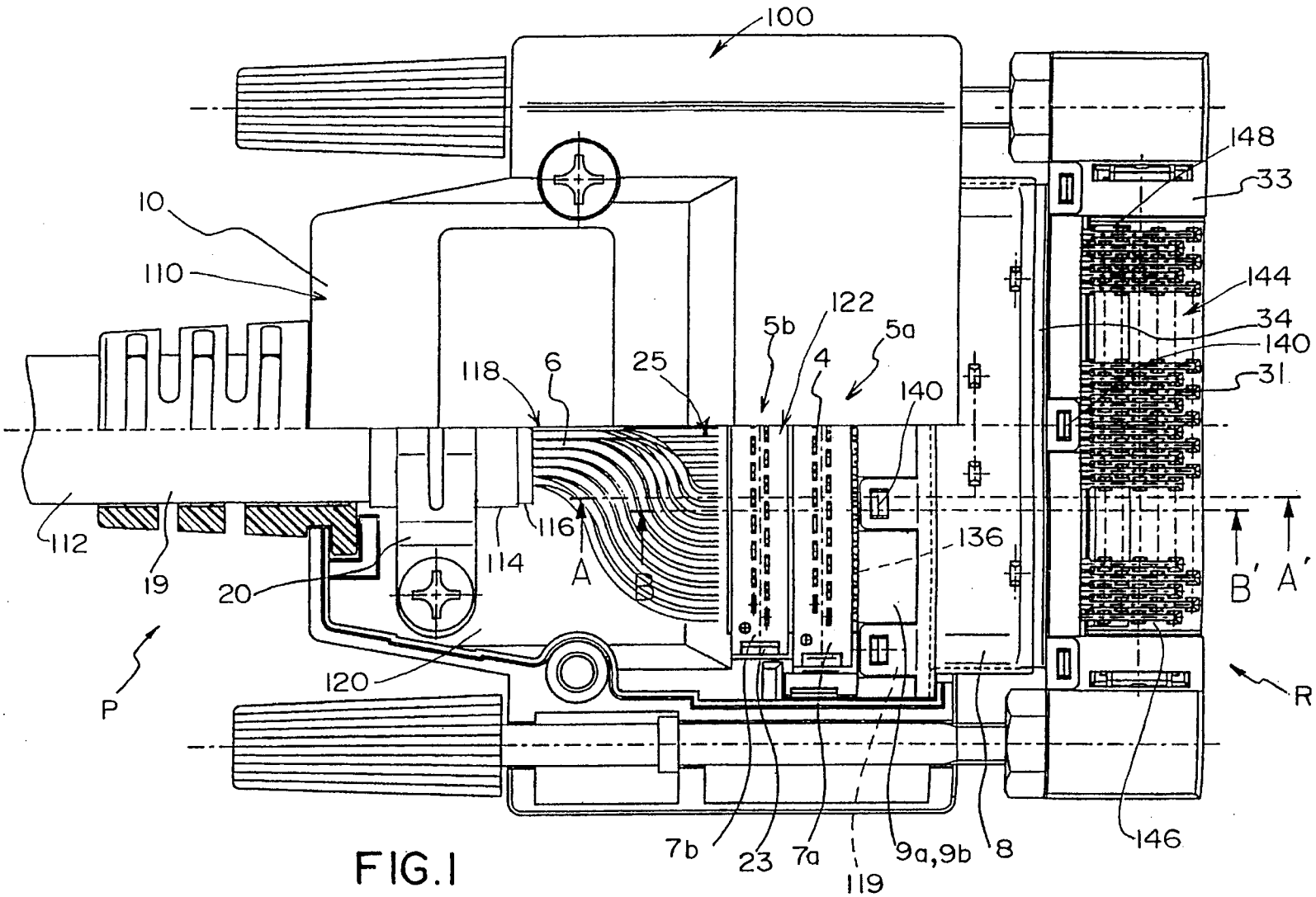
FIG. 1 is a plan view, partially in section, of an electrical connector constructed in accordance with the principles of the present invention.
Figure 2:
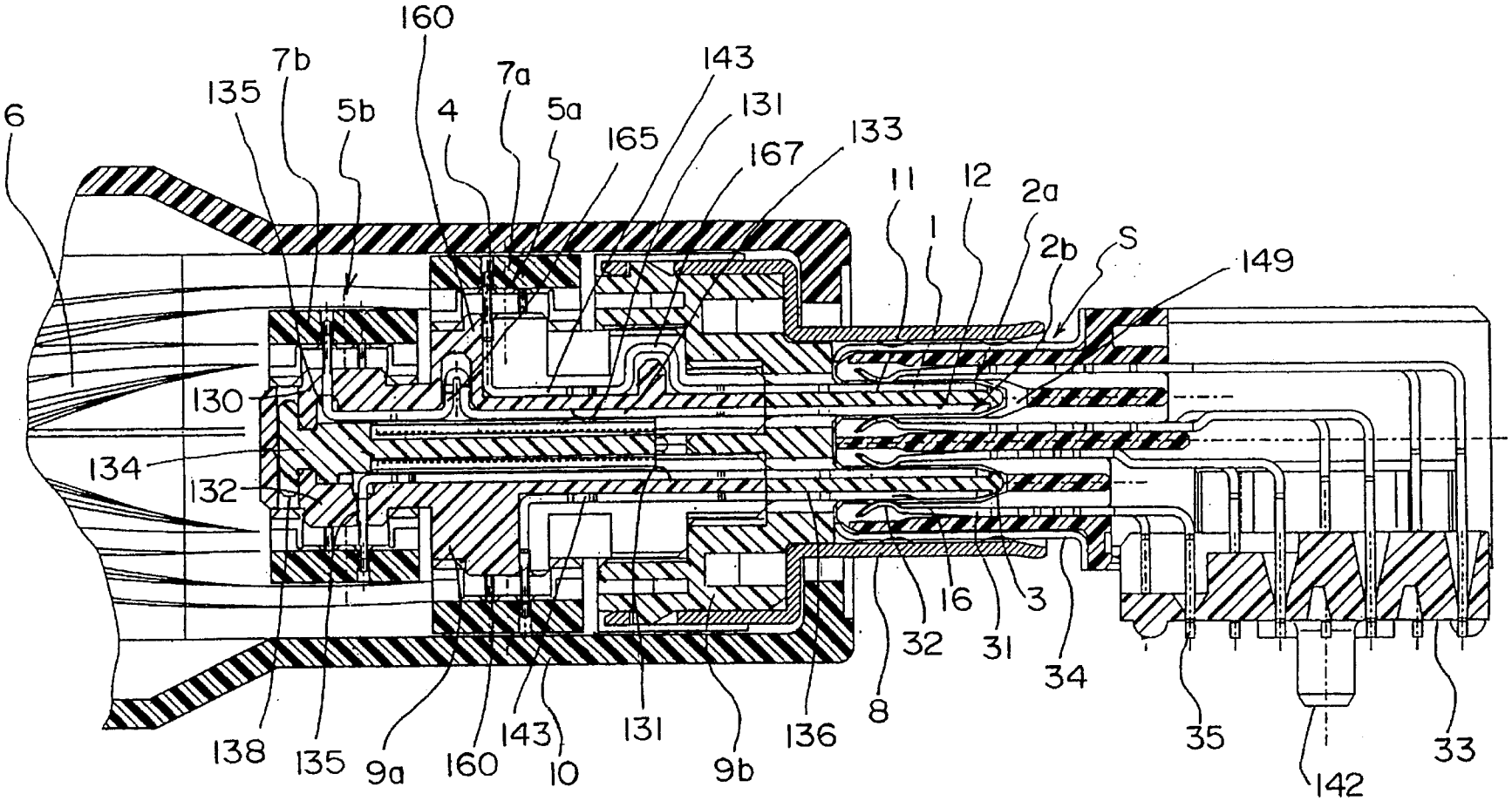
FIG. 2 is a longitudinal sectional view taken along line A-A' of the electrical connector of FIG. 1.
Figure 3:
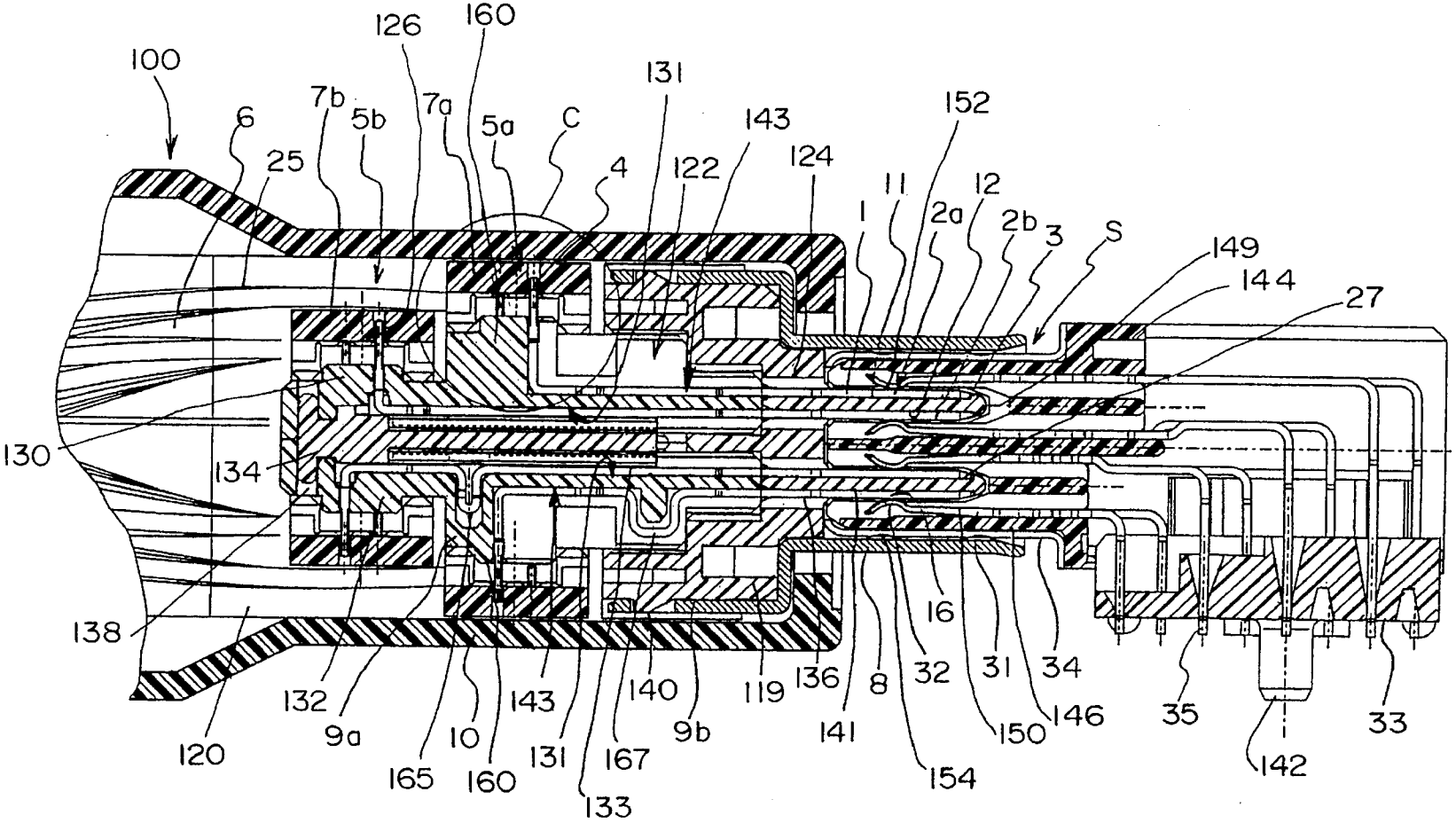
FIG. 3 is a longitudinal section taken along line B-B' of the electrical connector of FIG. 1.
Figure 4:
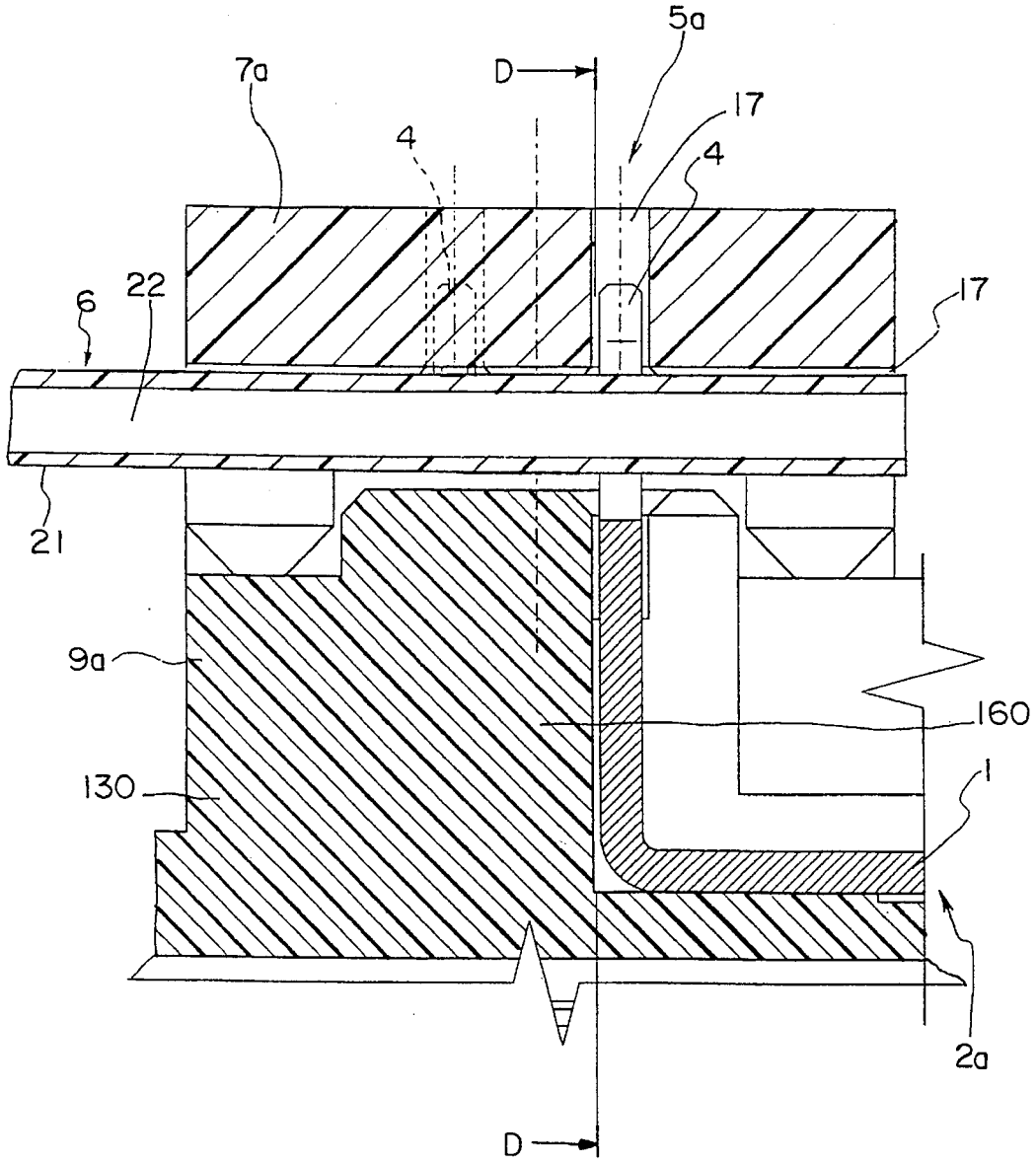
FIG. 4 is an enlarged longitudinal section of the inset C which is circled in FIG. 3.

FIGS. 1–3 illustrate an electrical connector 100 constructed in accordance with the principles of the present invention. The connector 100 includes a plug member P which is adapted to engage and effect an electrical connection with a receptacle or female connector member R. As seen in FIG. 1, the connector includes an exterior casing 10 and a multiple wire cable 19 extending therefrom at the rear portion of a casing 10. The cable is of a conventional shielded type having a outer insulation 112, and intermediate shielding portion 114 and an interior insulative portion 116 which substantially define the body of the cable 19.

The cable 19 is hollow and contains a plurality of conductive wires 6 which extend for the length of the cable 19 and free ends 25 of the wires 6 exit an open end 118 of the cable and enter the interior space 120 of the connector plug member P. The cable 19 is secured within the connector housing 10 by a suitable means, such as clamp 20. As will be explained in greater detail below and as illustrated best in FIG. 2, this interior space 120 serves as an enclosure for the cable open end 118, the ends of the cable wires 6, the connector terminal block assembly 122 and the connector bulkhead 119. These components are located within the space 120.

At the forward end of the plug connector P, a metal engagement shield 8 extends from within the connector interior space 120 outwardly to form a protective enclosure which surrounds the forward ends of the connector blades 3. This shield 8 engages the terminal block assembly 122 at lugs 140 and is held between the terminal block assembly 122 and the exterior casing of the male connector P. The shield 8 is spaced apart from the connector blades 3 and defines a space S into which a corresponding female connector member R fits, as illustrated in FIGS. 2 & 3.

The female receptacle member R is similar in structure to the male plug member in that it includes a casing 33 having means for engaging a circuit board, illustrated as posts 142 which are received by suitable openings in a printed circuit board (not shown). The casing 33 mates with a receptacle terminal block assembly 144 having a plurality of terminal supports 146 extending therefrom. These supports 146 may include channels or other suitable opening 148 which accommodate the receptacle member terminals 31. These terminals 31 are elongated and include, as illustrated in FIG. 2, free end portions 150 with suitable contact faces 152 disposed thereon.

The female terminal block assembly 144 may also have a metal shell 34 disposed thereon which surrounds the extending terminal supports 146 in order to provide an outer engagement surface thereto which may engage the interior of the male plug member metal shell 8 to form an effective and durable connection. In this regard, either shell 8 or 34 may include detents 154 to enhance the engagement between the male and female connector members P, R. The female terminals 31 preferably have tail portions 35 which extend out of the receptacle R for connection to circuit board traces such as by soldering or other suitable means. As is known in the art, the connector blades, or terminal support arms 3, of the male member P are received within corresponding slots 149 of the receptacle member R to establish a connection between the two connector components P and R.

Focusing specifically on the male connector member P, it can be seen from FIG. 2 that the free ends 25 of the wires 6 of the cable 19 are terminated to the terminal block assembly 122. This assembly 122 provides a foundation for a plurality of terminals 1 in order to hold them in place between top and bottom portions of the connector casing 10. The assembly 122 also engages an endwall portion 124 of the connector plug member bulkhead 119 and still further serves to orient the terminals 1 into a predetermined engagement position for proper electrical engagement with the corresponding opposing terminals 31 of the receptacle member R, when the two connector members P, R are mated together.

Figure 6:
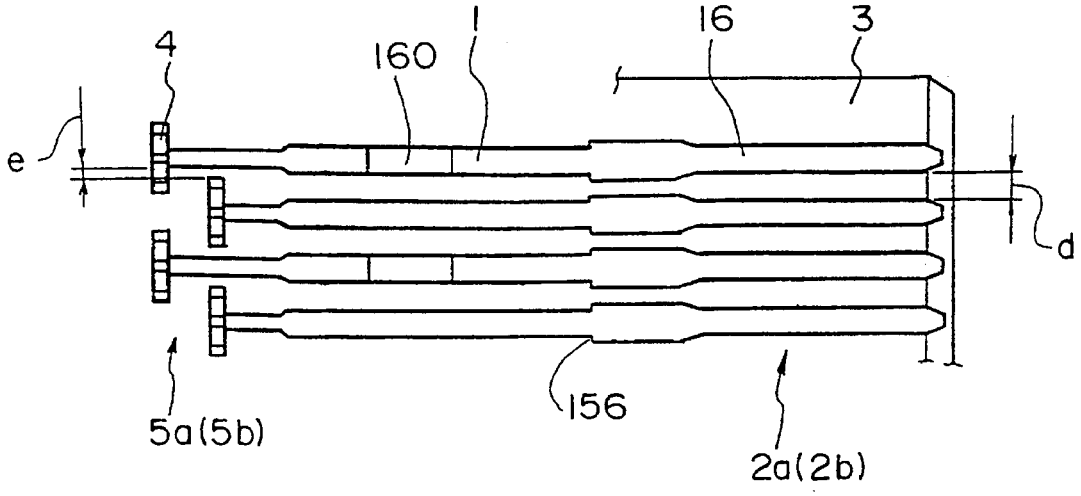
FIG. 6 diagram is a diagrammatic view illustrating how the terminals are arranged in a lateral fashion.

Turning now to FIGS. 2 & 6, it can be seen that each of the terminals 1 of the male connector member P includes an elongated contact blade portion 16 and a wire engagement portion, illustrated generally at 4, disposed on the terminal rearwardly of the contact blade portion 16. The wire engagement portion 4 is illustrated in the Figures as an insulation displacement assembly 126 which extends perpendicularly from the plane of the terminal contact blade portion 16 (or upwardly as illustrated in the Figures).

Figure 5:
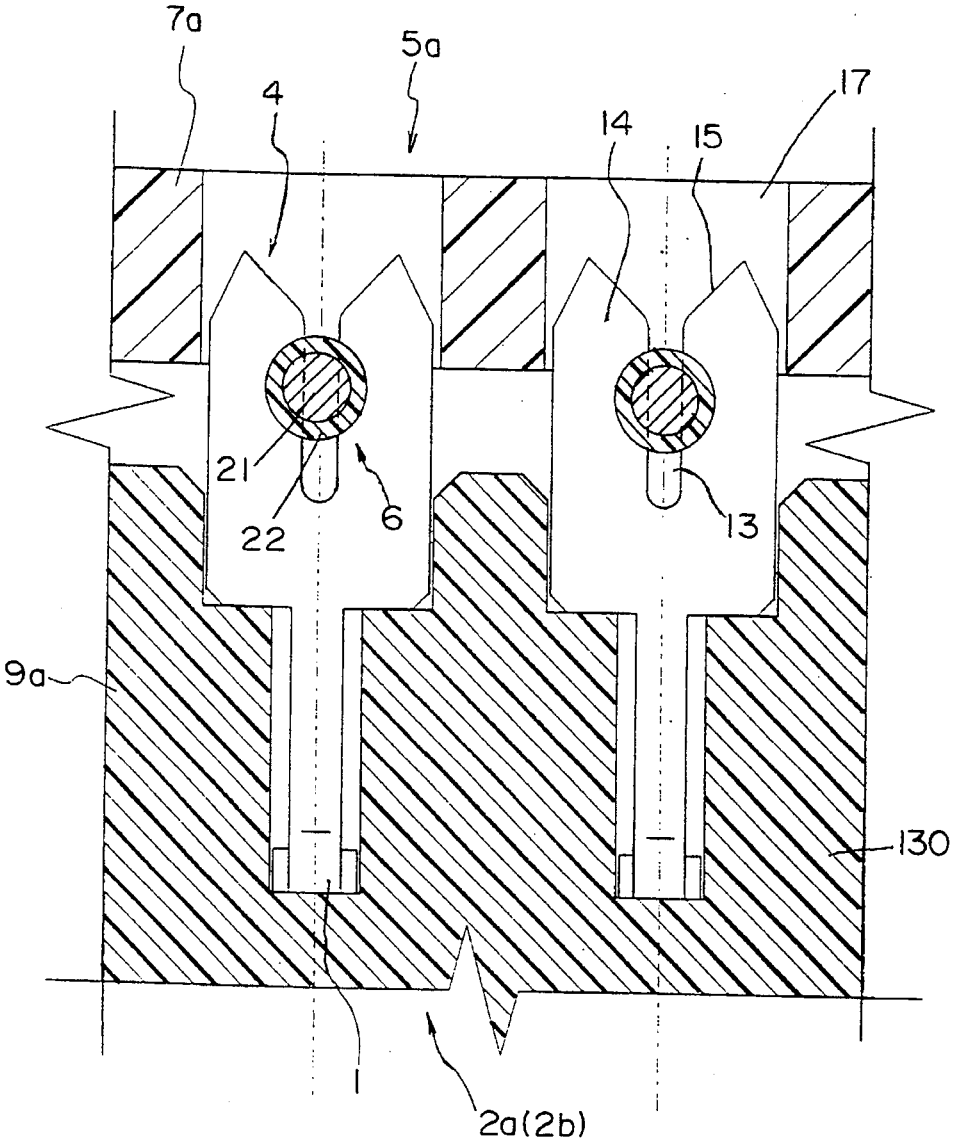
FIG. 5 is a cross-sectional view taken along line D-D of FIG. 4.

Each insulation displacement assembly 126 of the terminals 1 includes a pair of engagement prongs, or tines 14, which are separated from each other by an intervening slot 13. The slot 13 has a width which is slightly less than the diameter of the conductor portion 21 of the wire 6 so that when a wire 6 is pressed into the slot 13, the prongs 14 cut into its protective insulation 22 and pinch the conductor portion thereof 21, as is well known in the art. In order to assist entry of the wires 6 into the wire engagement portions 4, the prongs 14 thereof may include, as illustrated in FIG. 5, inwardly slanted surfaces 15 which direct a wire 6 under force into the central slot 13.

The plurality of terminals 1 of the present invention may be considered as including two distinct sets of terminals **2*a*, 2*b* associated with each of the two terminal block members 130, 132. Within these two sets, the terminals 2*b* which are arranged and received in the terminal bed portions 131 may be further considered as an "interior" set of terminals, in that in terms of the overall terminal block assembly 122, they are held between the two terminal block members 130, 132 and hence are disposed at the "interior" of the entire assembly 122. Likewise, the other sets of terminals 2*a* which are disposed on the outer wiring 143 surfaces of the terminal block members 130, 132** may be considered as an "exterior" set of terminals.

Figure 7:
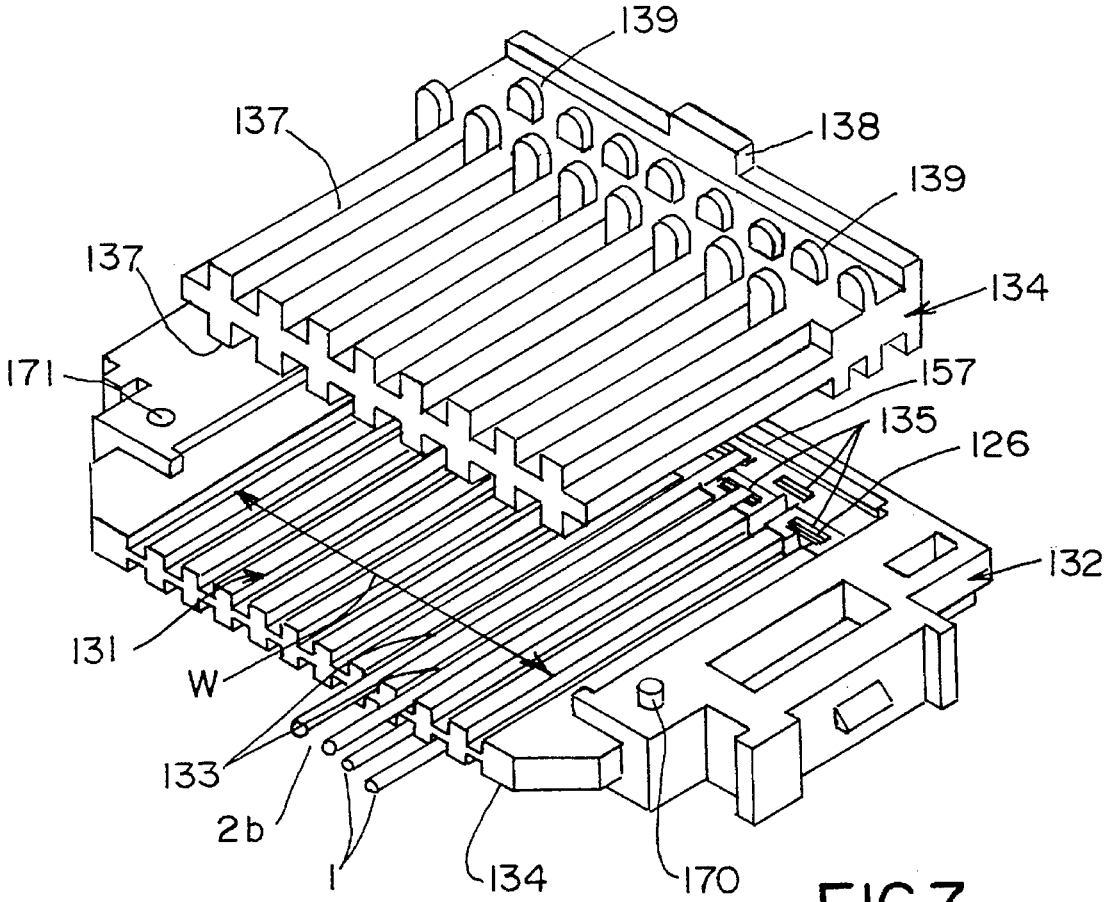
FIG. 7 is an exploded view, taken from above and illustrating the alignment and engagement of the lower terminal support intervening spacer and terminals; and, FIG. 8 is a partial cross-sectional view of the terminal block assembly taken from the rear and through the intervening spacer and the terminal bed portions thereof which receive the interior set of terminals.

Returning to FIGS. 1 & 2, the terminal block assembly 122 is seen to include two interengaging terminal block members 130, 132 and an intervening spacer member 134 which is effectively sandwiched in the interior of the assembly 122 between the two terminal block members 130, 132. Each terminal block member 130, 132 includes a terminal bed portion 131, which as shown in FIG. 7, includes a plurality of slots 133 formed therein extending approximately lengthwise for the particular terminal block member bed portion 131. The block members 130, 132 may include suitable engagement means, such as posts 170 which are received in corresponding openings 171 of an opposing block member.

Each such slot 133 of the bed portion 131 accommodates a terminal 1 of the interior terminals **2*b*. Rearwardly of the slots 133, a series of recesses 135 are formed in the terminal block member 132, preferably in two parallel rows, which extend into the member 132 and open up on the opposite, or wiring surface 143 thereof. These recesses 135 receive the projecting insulation displacement assemblies 126 of the terminals 1 in such a manner that the two prongs 14 of each such assembly extend upwardly above the wiring surface 143 of the members 130, 132**.

Although the terminals 1 include engagement edges 156 at their contact blade portions 16 which serve to engage the slots of the terminal bed portions 131, the intervening spacer 134 of the terminal block assembly 122 is preferably provided with a series of raised land portions 137 which extend outwardly from the spacer 134 which are aligned, preferably in a one-to-one correspondence, with the terminal receiving slots 133 and terminals 1 disposed therein. These land portions 137 effectively assist the slots 133 and maintain the terminals 1 in place upon the terminal member 132. The land portions 137 are disposed on each opposing surface of the spacer 134 in the same pattern spacing so as to render the spacer hermaphroditic, or reversible. That is, the spacer 134 has no unique orientation with respect to the terminal block members 130, 132 so that either surface of the spacer 134 may be used to engage either terminal block member 130, 132. In order to retain it in place in the terminal block assembly 122, the spacer 134 may include an engagement lug 138 or a rear wall thereof which is received within a slot of the terminal block members 130, 132.

Figure 8:
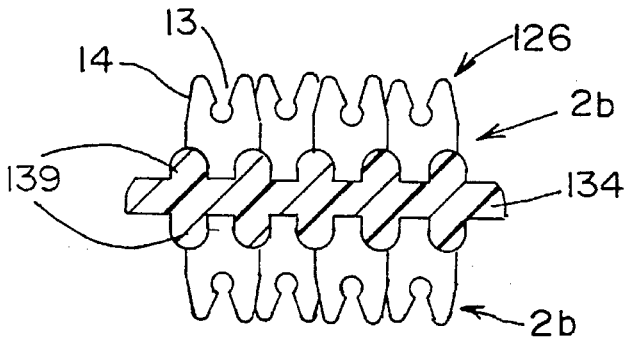

In an important aspect of the present invention, the spacer 134 also preferably includes a plurality of extending projections 139 arranged in an array such that generally four projections 139 may be considered to be associated with each land portion 137. The array of projections 139 are spaced apart from each other longitudinally and are preferably positioned to match the staggered arrangement of wire engagement portions 4 of the interior sets of terminals of the terminal block member 130, 132, such that, as illustrated in FIG. 8, the projections 139 flank the terminal wire engagement portions 4 and support them as shown. The spacer 134 provides support for only the interior set of terminals of the terminal block assembly 122 and not to the exterior terminals disposed on the wiring surfaces 143 of the assembly 122. The spacer projections 139 are arranged in two spaced apart rows on the spacer 134 so that they will supportingly engage the staggered rows of terminals of the interior terminal sets **2*b***.

Returning to FIGS. 2 and 7, it may be noted that the interior and exterior sets of terminals **2*b*, 2*a* include free ends 17 on their contact blade portions which extend lengthwise out from the terminal bed portions 131 and are spaced apart from each other a distance which corresponds to the thickness of the terminal support arms 3. These free ends 17 are received upon the elongated support arms 3, which as illustrated in FIGS. 2 & 3, abut against the ends of the terminal bed portions 131 of the two block members 130, 132 and which extend from the connector bulkhead 119**.

The bulkhead 119 includes openings 136 which accommodate the terminal free ends 17 and which lead to channels 141 which receive the terminal free ends 17 and portions of the contact blade portions 16 thereof such that the two terminal support arms 3 will establish a connection when they are received in the opposing engagement slots 149 of the receptacle member R.

In an important aspect of the present invention, the terminals 1 of the male connector member are arranged widthwise upon the terminal supports 3 in a lateral, staggered arrangement along the surface of the terminal support 3 illustrated in FIG. 1 and indicated by the line W therein.

Turning briefly to FIG. 6, the arrangement of the terminals 1 is diagrammatically illustrated wherein a group of four terminals 16 are shown in spaced-apart order with an intervening space d between adjacent terminals at the contact blade portions 16 thereof. The terminals 1 each have their wire engagement portions 4 (extending upwardly from the plane of the paper) arranged at their rear ends in a staggered fashion. That is, every other terminal is aligned along the width W of the terminal block assembly 122 to define one group of terminals while the remaining intervening terminal are aligned among themselves along the rear faces of their wire engagement portions 4 to define another distinct group of terminals set apart from the first group by the lateral spacing. Therefore, all of the terminals at their wire engagement portions 4, are spaced apart from each other a distance "e". In this manner, an increased density of terminals has been obtained resulting in desired pitches of approximately 1 mm.

Although the interior and exterior sets of terminals are disposed on opposing upper and lower surfaces of the terminal block members 130, 132, the wire engagement portions 4 of these two sets are located upon only one of these two surfaces of each block member. As illustrated in FIG. 2, the wire engagement portions 4 of the first terminal support 3 appear on the upper wiring surfaces 143 of the upper block member 130, while the wire engagement portions 4 of the lower block member 132 appear on the lower wiring surfaces 143 thereof.

In order to assist in reducing the pitch of the terminals 1, alternating terminals of each set of terminals 2*a*, 2*b* are folded upon themselves at 165 during formation of the terminals, such as by a suitable stamping and forming process. These folds occur at 165 and they permit the length of the terminals to be adjusted exactly prior to insertion into their respective channels of the terminal block members 130, 132. Certain of the terminals may also have a loop 167 formed therein for engaging the wiring surfaces 143 as well as locating the wire engagement portions 4.

As mentioned above, the terminals are also staggered along the length of the terminal block members 130, 132 in two distinct sets of terminals 2*a* and 2*b* which are separated into two distinct tiers of terminals appearing at different elevations of the terminal block members 130, 132 to present an overall stepped configuration. The terminals 2*a* are seen to lie upon the terminal block member top surface above the terminals 2*b* which abut the terminal block member lower surface. The wire engagement portions of these two sets of terminals as indicated by their respective insulation displacement prongs are further staggered lengthwise along the terminal block members. In this manner, the wires terminated to the upper set of terminals lie above the wires terminated to the lower set of terminals.

Each terminal block member 130, 132 preferably includes an abutment 160 disposed near its rearward end which facilitates the arrangement of the terminal wire engagement portions 4 at different tiers and which separates the two terminal sets 2*a*, 2*b* whereby the sets of interior terminals 2*b* have their wire engagement portions 4 rise on one side of the abutment 160 (shown to the left in FIGS. 2 and 3) and the sets of exterior terminals 2*a* have their wire engagement portions 4 rise on the other side of the abutment 160 (shown to the right in FIGS. 2 and 3). Cover plates 7*a*, 7*b* may be provided as shown to engage these staggered arrangements 5*a*, 5*b*. Each cover plate 7*a*, 7*b* is preferably provided with a plurality of slots 17 corresponding in number to the number of wire engagement portions 4 of the terminals 1 of each terminal support set. The cover plates 7*a*, 7*b* and their slots 17 are aligned with the engagement prongs 156 and subsequently snapped into place by way of engagement lugs 23 to ensure a reliable connection between the wires 6 and the insulation displacement terminals 4 and to retain them in place. The cover plates 7*a*, 7*b* may have their associated wires attached thereto, such as by lamination to form a single component so that the wires are terminated to the insulation displacement assemblies 126 when the cover plates are attached to the terminal block assembly 122.

It will be appreciated that the embodiments of the present invention discussed herein are merely illustrative of a few applications of the principles of the invention. Numerous modifications may be made by those skilled in the art without departing from the true spirit and scope of the invention.

We claim:

1. An electrical I/O connector for establishing an electrical connection between a plurality of individual wires and electronic device, said connector comprising: a housing, a terminal block assembly disposed within said housing to which said plurality of individual wires are terminated, said terminal block assembly including two interengaging terminal block halves, a plurality of contact terminals disposed on said terminal block assembly in spaced-apart order widthwise along opposing surfaces of said terminal block halves, each of said terminals including an elongated contact blade portion and a wire engagement portion, four distinct sets of said terminals being disposed on four distinct surfaces of said terminal block assembly, a spacer held between said terminal block halves, said spacer separating second and third sets of said four terminal sets disposed on confronting surfaces of said terminal block halves, said spacer further maintaining said second and third terminal sets in said spaced-apart order, said wire engagement portions of said four terminal sets extending outwardly from said contact blade portions onto two wiring surfaces of said terminal block assembly, said four terminal sets being further defined on said terminal block assembly wiring surfaces in terms of their associated wire engagement portions, first and second sets of said four terminal sets having their wire engagement portions disposed on a first wiring surface of said terminal block assembly, and third and fourth sets of said four terminal sets having their wire engagement portions disposed on a second wiring surface of said terminal block assembly spaced apart from said terminal block assembly first wiring surface, said wire engagement portions of said first and second terminal sets being spaced apart longitudinally on said terminal block assembly first wiring surface, and said wire engagement portions of said third and fourth terminal sets being spaced apart longitudinally on said terminal block assembly second wiring surface, alternating ones of said wire engagement portions further being staggered lengthwise within each of said four terminal sets to thereby reduce the pitch between said terminals.

2. The I/O connector as defined in claim 1, wherein said terminal block halves include terminal bed portions disposed interior of said terminal block assembly wiring surfaces, said terminal bed portions including a plurality of elongated slots which receive said second and third terminal sets.

3. The I/O connector as defined in claim 2, wherein said spacer includes a plurality of ribs spaced apart along the width of said spacer, said ribs opposing in a one-to-one correspondence terminals of said second and third terminal sets and maintaining said terminals in position on said terminal bed portions.

4. The I/O connector as defined in claim 1, wherein said terminal block halves include a plurality of recesses which receive said second and third terminal set wire engagement portions, and wherein said spacer includes a plurality of supports disposed thereon which support said second and third terminal set wire engagement portions in place within said terminal block assembly.

5. The I/O connector as defined in claim 1, further including a connector bulkhead having two terminal support arms, said two terminal block halves engaging said terminal support arms such that said terminals extend from said terminal block assembly onto said terminal support arms.

6. The I/O connector as defined in claim 1, wherein said terminal wire engagement portions include insulation displacement terminals having two wire engaging prongs separated by an intervening slot.

7. The I/O connector as defined in claim 1, wherein each of said terminal block halves includes an abutment, which supports said second distinct terminal set at an elevation spaced apart from that of said first distinct terminal set.

8. The I/O connector as defined in claim 1, wherein alternating terminals of each of said two distinct terminal sets are folded upon themselves intermediate of said contact blade and wire engagement portions.

9. The I/O connector as defined in claim 8, wherein said terminals are stamped and formed.

10. The I/O connector as defined in claim 1, wherein said housing encloses said terminal block assembly, the housing having an endwall which includes two terminal support arms extending away from said endwall, said endwall including a plurality of openings associated therewith and disposed therein in alignment with opposing surfaces of said terminal support arms, said endwall openings receiving said terminals of said terminal block assembly therein and said terminal block halves abutting said terminal support arms, whereby said terminals extend through said openings and are supported on said terminal support arms.

11. The I/O connector as defined in claim 1, wherein said terminals have a pitch of approximately 1 mm.

12. The I/O connector as defined in claim 1, further including a plurality of cover plates corresponding in number to said four distinct terminal sets, said cover plates engaging said wire engagement portions of said distinct terminal sets and retaining wires held in said wire engagement portions in contact therewith.

13. The I/O connector as defined in claim 1, wherein each of said terminal wire engagement portions includes a pair of erect prongs and said terminal block assembly includes cover plates having a series of slots disposed therein in alignment with said terminal wire engagement prongs, said cover plate slots engaging said terminal wire engagement prongs to thereby retain wires in place on said terminal wire engagement portions.

14. A connector assembly for establishing an electrical connection between electronic devices, one of said devices having a receptacle which engages said connector, comprising:

a housing having an endwall which opposes said receptacle said endwall having at least one connector blade portion which extends outwardly from said endwall and engages a portion of said receptacle;

a terminal block assembly disposed within said housing, said terminal block assembly including a terminal support block, a plurality of elongated terminals extending lengthwise on said terminal support block, said terminals being disposed on said terminal support block in two distinct sets of terminals, one terminal set extending along one surface of said terminal block and the other terminal set extending along an opposite surface of said terminal block, said terminals including elongated contact portions extending along said terminal block one and opposite surfaces, said terminals further including wire engaging rearwardly of said terminal contact blade portions, said wire engaging portions extending upwardly from said terminal block opposite surface, said wire engaging portions being arranged on said terminal block opposite surface in first and second distinct arrays such that said first wire engaging portion array corresponds to said one terminal set and said second of said wire engaging portion array corresponds to said other terminal set, said first and second wire engaging portion arrays being spaced apart from each other longitudinally on said terminal block opposite surface, said terminal wire engaging portions being staggered with respect to each other on said terminal block opposite surface within each of said first and second arrays, whereby said staggered and spaced-apart arrangement of said first and second arrays of said wire engaging portions permits the pitch of said terminals to be reduced; and a cable having a plurality of wires extending therein, said cable having an open end disposed within said housing, said wires having free ends extending out of said cable open end and into said housing into contact with said terminal wire engagement portions.

15. The connector assembly as defined in claim 14, further including wire retention members which retain said wire free ends in contact with said terminal wire engaging portions.

16. The connector assembly as defined in claim 14, wherein each of said wire engaging portions includes a pair of tines separated by an intervening slot, each of said slots receiving a single wire of said cable therein such that said tines electrically engage conducting portions of said wire by way of insulation displacement, the connector assembly further including cover plates which engage said tines of said two arrays of said wire engaging portion.

17. The connector assembly as defined in claim 14, wherein said terminal block opposite surface includes an abutment extending therefrom, and said second wire engaging portion array is being disposed upon said abutment, whereby said first and second wire engaging portion arrays are presented at different elevations of said opposite terminal block surface.

18. The connector assembly as defined in claim 14, further including a second terminal support block having a second set of elongated terminals extending lengthwise thereon, said second terminals being further disposed on said second terminal support block in two distinct sets, one set of second terminals extending along one surface of said second terminal support block and the other set of second terminals extending along an opposite surface of said second terminal support block, said one and second terminal support blocks being arranged such that their respective one surfaces confront each other.

19. The connector assembly as defined in claim 18, further including a spacer disposed between said one and second terminal support blocks, said spacer including projections extending therefrom toward at least said one terminal support block proximate to said wire engaging portions of first terminal support block one terminal set, whereby said projections supportingly engage said first array of wire engaging portions.

20. The connector assembly as defined in claim 18, wherein said one and other sets of second terminals include wire engaging portions extending from said second terminal support block in a direction generally opposite that of said wire engaging portions of said first terminal support block terminals, said second terminal wire engaging portions being arranged in first and second distinct arrays spaced apart from each other longitudinally on said second terminal block opposite surface.

21. The connector assembly as defined in claim 20, wherein said second terminal two arrays of wire engaging portions are disposed on said second terminal block opposite at different elevations.

22. A terminal block assembly for use in an electrical connector for establishing a connection between a plurality of individual wires and an electronic device, the terminal block assembly having a reduced pitch between terminals, the terminal block assembly comprising:

first and second interengaging terminal support members, a spacer interposed between the first and second terminal support members, a plurality of terminals associated with said terminal support members, said first and second terminal support members each having first and second sides, said spacer being interposed between said first sides of said first and second terminal support members, said terminals being arranged in four distinct sets upon said terminal block assembly, a first terminal set being disposed on said first terminal support member first side, a second terminal set being disposed on said first terminal support member second side, a third terminal set being disposed on said second terminal support member first side and a fourth terminal set being disposed on said second terminal support member second side, all of said terminals including erect wire engagement ends which extend outwardly from opposite sides of said terminal block assembly in four distinct groups, first and second groups of wire engagement ends extending outwardly from said first terminal block first side, and third and fourth groups of wire engagement ends extending outwardly from said second terminal block second side, said first and second groups and said third and fourth groups of wire engaging ends being respectively spaced apart from each other lengthwise on said terminal block assembly and at different elevations thereon.

23. The terminal block assembly as defined in claim 22, wherein said terminal wire engaging ends include insulation displacement members.

24. The terminal block assembly as defined in claim 23, further including cover plates which extend widthwise along said terminal block assembly, each cover plate being associated with one of said four groups of terminal wire engaging ends.

* * * * *